US009917401B2

(12) United States Patent
Nagase et al.

(10) Patent No.: US 9,917,401 B2
(45) Date of Patent: Mar. 13, 2018

(54) WIRE-TO-BOARD CONNECTOR ASSEMBLY

(71) Applicant: Molex, LLC, Lisle, IL (US)

(72) Inventors: Teruki Nagase, Yamato (JP); Takuji Hanyu, Yamato (JP); Akihiro Shimotsu, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/248,391

(22) Filed: Aug. 26, 2016

(65) Prior Publication Data

US 2017/0110828 A1 Apr. 20, 2017

(30) Foreign Application Priority Data

Oct. 16, 2015 (JP) ..... 2015-204825

(51) Int. Cl.
*H01R 13/627* (2006.01)
*H01R 12/75* (2011.01)

(52) U.S. Cl.
CPC ..... *H01R 13/6272* (2013.01); *H01R 12/75* (2013.01)

(58) Field of Classification Search
CPC ..... H01R 13/6271; H01R 13/6272
USPC ..... 439/358, 357
See application file for complete search history.

(56) References Cited

U.S. PATENT DOCUMENTS 5,338,219 A 8/1994 Hiramoto et al.
5,830,002 A 11/1998 Ito et al.
6,332,800 B2 * 12/2001 Kodama ..... H01R 13/6273 439/357
7,431,605 B2 * 10/2008 Dieterle ..... H01R 13/6272 439/358
7,824,234 B2 11/2010 Kamata et al.
8,133,078 B2 * 3/2012 Lin ..... H01R 27/00 439/218

FOREIGN PATENT DOCUMENTS

JP 2000-123912 A 4/2000
JP 2006-032161 A 2/2006
TW M441251 U 11/2012

* cited by examiner

*Primary Examiner* — Phuong Dinh
(74) *Attorney, Agent, or Firm* — James A. O'Malley

(57) ABSTRACT

The second housing has a side panel extending in the mating direction and at least three second connector lock portions protruding from the outer surface of the side panel, the second connectors each being arranged in the transverse direction of the second housing and separated by an interval, and the first housing has a side panel extending in the mounting direction, a locking arm portion formed in the side panel and covering at least a portion of the outer surface of the side panel of the second housing when the first housing and the second housing are mated, and at least three first connector locking portions each formed in the locking arm portion in the transverse direction of the first housing and separated by an interval, and each engaging a second connector locking portion when the first housing and the second housing are mated.

7 Claims, 12 Drawing Sheets

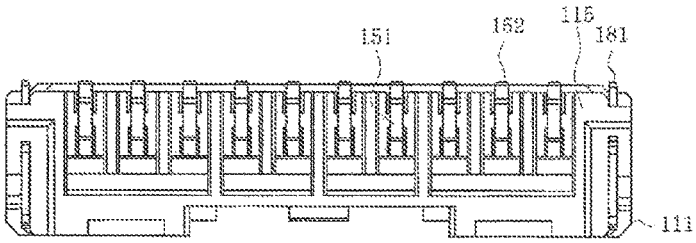
FIG. 4C
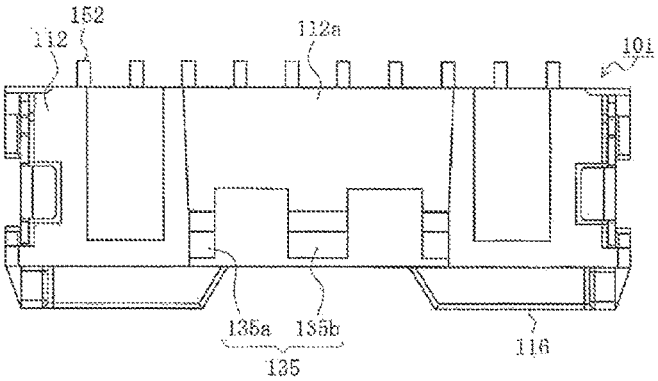
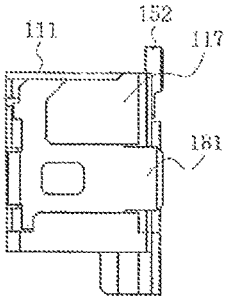
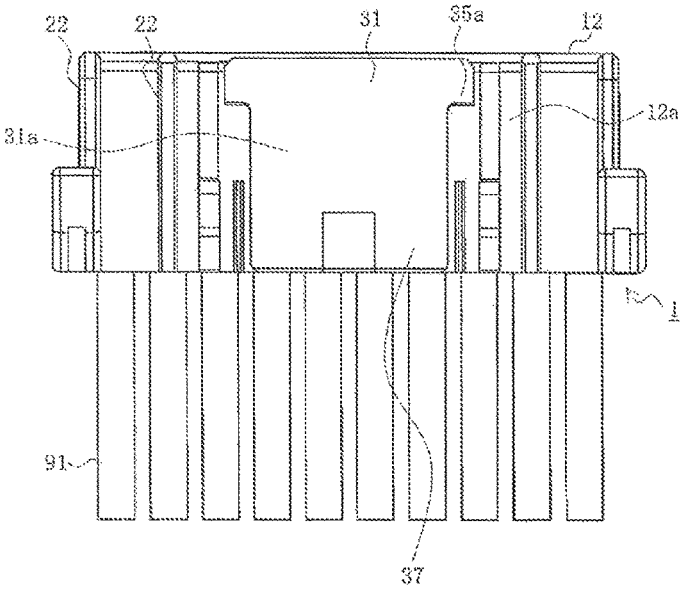
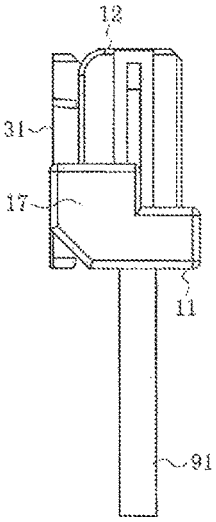
FIG. 4A
FIG. 4B

WIRE-TO-BOARD CONNECTOR ASSEMBLY

RELATED APPLICATIONS

This application claims priority to Japanese Application No. 2015-204825, filed Oct. 16, 2015, which is incorporated herein by reference in its entirety.

TECHNICAL FIELD

The present disclosure relates to a connector.

BACKGROUND ART

A so-called wire-to-board connector is used to connect electrical wiring such as cables to a circuit board such as a printed circuit board. In this connector, one connector is mounted on the board, and is then mated with another connector connected to the ends of the cables (see, for example, Patent Document 1).

FIG. 12 is a perspective view showing the situation before a connector of the prior art is mated.

In this drawing, 951 denotes the terminals in the board connector which are press-fitted and mounted on a bottom panel of a housing 911 made of an insulating material. The bottom ends of each of the terminals 951 pass through the board 991 and are soldered to a member such as a conductive trace formed on the back surface of the board 991. The board connector is secured to the board 991 in this way. The housing 911 includes a recessed portion 913 opening upwards to expose the upper ends of the terminals 951 inside the recessed portion 913.

Also, 811 is the housing in the wire connector and wire-side terminals (not shown) connected to the ends of each electrical wire 891 mounted in the housing. The housing 811 is moved in the direction of the arrow shown in the drawing, and the board connector is inserted into the recessed portion 913 of the housing 911 to mate the wire connector with the board connector. In this way, the wire-side terminals connected to the ends of each of the electrical wires 891 come into contact with the corresponding terminal 951, and each electrical wire 891 establishes an electrical connection with the corresponding conductive trace on the board 991.

A pair of protrusions 935 are formed on the front surface of the housing 911 in the board connector. Also, a band-like arm 831 is provided on the front surface of the housing 811 in the wire connector. The arm 831 is slidably mounted on the front surface of the housing 811 via an elastically deformable support portion not shown in the drawing. A hook-shaped hook portion 835 is formed on the bottom end of the arm 831 which protrudes towards the front surface of the housing 811.

When the housing 811 in the wire connector is inserted into the recessed portion 913 of the housing 911 in the board connector and the wire connector and the board connector are mated, the sliding arm 831 causes the hook portion 835 to overcome the protrusions 935 and engage the bottom end of the protrusions 935. In this way, the wire connector and the board connector are locked, and the wire connector is kept from becoming detached from the board connector.

Because the pair of protrusions 935 are separated from each other in the transverse direction, the hook portion 835 remains engaged with the left and right protrusions 935 even when the wire connector is subjected to an external force inclined with respect to the transverse direction. In other words, the connectors remain reliably locked.

When the wire connector has to be detached from the board connector, the operator manually presses the upper portion 837 of the arm 831 against the front surface of the housing 811 to slide the arm 831 and disengage the hook portion 835 from the protrusions 935. In this way, the connectors can be unlocked.

Patent Document 1: Laid-Open Patent Publication No. 2000-123912

SUMMARY

However, in a connector of the prior art, when a board connector is inserted into the recessed portion 913 of the housing 911 of the board connector with the housing 811 of the board connector askew in the transverse direction, the lower end of the arm 831 becomes twisted. Here, one of the protrusions 935 may engage the hook portion 835, while the other protrusion 935 remains unengaged with the hook portion 835. In this situation, the operator may hear or feel a click due to one of the protrusions 935 engaging the hook portion 835 and falsely come to believe that the locking process has been completed. Because the protrusions 935 are covered by the arm 831, the operator cannot visually confirm that both protrusions 935 have engaged the hook portion 835, that is, that the locking operation has been completed.

Therefore, when the locking operation has not been completed, some of the wire-side terminals may not have come into contact with the proper terminals 951, and the mounting of the wire connector and the board connector is not complete. Also, the other protrusion 935 remains disengaged from the hook portion 835 and the insertion of the housing 811 of the wire connector into the recessed portion 913 of the housing 911 in the board connector is completed. As a result, the wire connector may become detached from the board connector when subjected to an external shock.

The present disclosure seeks to solve this problem by providing a reliable connector having at least three locking portions arranged in the transverse direction so that the completion of the locking process is not falsely recognized when one of the connectors is skewed in the transverse direction relative to the other connector and one of the locking portions has not locked. In this way, when both connectors are properly mated and locked, one of the connectors does not become detached from the other connector when subjected to an external force applied obliquely relative to the transverse direction. The mating operation can also be reliably completed in a short period of time.

The present disclosure is a connector comprising a first connector including a first housing and first terminals embedded in the first housing and a second connector including a second housing and second terminals embedded in the second housing and contacting the first terminals, the second housing having a side panel extending in the mating direction and at least three second connector lock portions protruding from the outer surface of the side panel, the second connectors each being arranged in the transverse direction of the second housing and separated by an interval, and the first housing including a side panel extending in the mounting direction, a locking arm portion formed in the side panel and covering at least a portion of the outer surface of the side panel of the second housing when the first housing and the second housing are mated, and at least three first connector locking portions each formed in the locking arm portion in the transverse direction of the first housing and separated by an interval, and each engaging a second connector locking portion when the first housing and the second housing are mated.

In another connector, the second connector locking portions have similar side profiles and are formed in the same position relative to the mating direction, and the first connector locking portions have similar side profiles and are formed in the same position relative to the mating direction.

In another connector, each second connector locking portion has at least one second central locking portion and a pair of second end locking portions on both ends, and each first connector locking portion has at least one first central locking portion and a pair of first end locking portions on both ends.

In another connector, the locking arm portion includes a main body portion having no opening, a first end locking portion protruding from both left and right ends of the front end section of the main body portion, and the first central locking portion is the inner surface of the main body portion opposing at least some of the outer surface of the side panel of the second housing when the first housing and the second housing are mated.

In another connector, the first end locking portion and the second end locking portion engage each other visibly from outside of the locking arm portion, and the first central locking portion and the second central locking portion engage each other non-visibly from outside of the locking arm portion when the first housing and the second housing are mated.

In another connector, the second housing includes another side panel facing the side panel, and a slide fitting portion formed at a position corresponding to the second connector locking portion in the other side panel, the slide fitting portion being a ridge-like protruding key or trench-like key groove, and the first housing includes a trench-like key groove or ridge-like protruding key fitting into the slide fitting portion.

In another connector, the first connector is a wire connector connecting the first terminals to electrical wires, and the second connector is a board connector connecting the second terminals to a board.

The present disclosure is able to provide a reliable connector having at least three locking portions arranged in the transverse direction so that the completion of the locking process is not falsely recognized when one of the connectors is skewed in the transverse direction relative to the other connector and one of the locking portions has not locked. In this way, when both connectors are properly mated and locked, one of the connectors does not become detached from the other connector when subjected to an external force applied obliquely relative to the transverse direction. The mating operation can also be reliably completed in a short period of time.

BRIEF DESCRIPTION OF THE DRAWINGS

FIGS. 3A-3C are a set of three drawings showing a wire connector and a board connector in an embodiment of the present disclosure after they have been mated, in which FIG. 3A is a top view, FIG. 3B is a side view, and FIG. 3C is a rear view from behind the board connector.

FIGS. 4A-4C are a set of three drawings showing a wire connector and a board connector in an embodiment of the present disclosure before they have been mated, in which FIG. 4A is a top view, FIG. 4B is a side view, and FIG. 4C is a rear view from behind the board connector.

FIGS. 5A and 5B are partial top views showing the positional relationships between the wire-side locking portions of the wire connector and the board-side locking portions of the board connector in an embodiment of the present disclosure, in which FIG. 5A is the view before the wire connector and the board connector have been mated, and FIG. 5B is the view after the wire connector and the board connector have been mated.

FIGS. 6A and 6B are partial perspective views showing the positional relationship between the wire-side locking portions of the wire connector and the board-side locking portions of the board connector in an embodiment of the present disclosure, in which FIG. 6A shows the situation between the wire connector and the board connector after they have been mated, and FIG. 6B shows the situation after the wire connector and the board connector have been mated.

FIGS. 7A and 7B are perspective views showing the inside of the movable arm on the wire connector in an embodiment of the present disclosure, in which FIG. 7A is a view from below at the front, and FIG. 7B is the view from below at the rear.

FIGS. 8A-8C are a first set of views showing the change in the positional relationship between the wire-side locking portions of the wire connector and the board-side locking portions of the board connector in an embodiment of the present disclosure, in which FIG. 8A is a top view, FIG. 8B is a side view, and FIG. 8C is a cross-sectional side view from arrows A-A in FIG. 8A.

FIGS. 9A-9C are a second set of views showing the change in the positional relationship between the wire-side locking portions of the wire connector and the board-side locking portions of the board connector in an embodiment of the present disclosure, in which FIG. 9A is a top view, FIG. 9B is a side view, and FIG. 9C is a cross-sectional side view from arrows A-A in FIG. 9A.

FIGS. 10A-10C are a third set of views showing the change in the positional relationship between the wire-side locking portions of the wire connector and the board-side locking portions of the board connector in an embodiment of the present disclosure, in which FIG. 10A is a top view, FIG. 10B is a side view, and FIG. 10C is a cross-sectional side view from arrows A-A in FIG. 10A.

FIGS. 11A and 11B are a pair of views showing the positional relationship when the wire connector is skewed in the transverse direction relative to the board connector in an embodiment of the present disclosure, in which FIG. 11A is a top view and FIG. 11B is a partial enlarged top view.

DETAILED DESCRIPTION OF THE PREFERRED EMBODIMENTS

Figure 1:
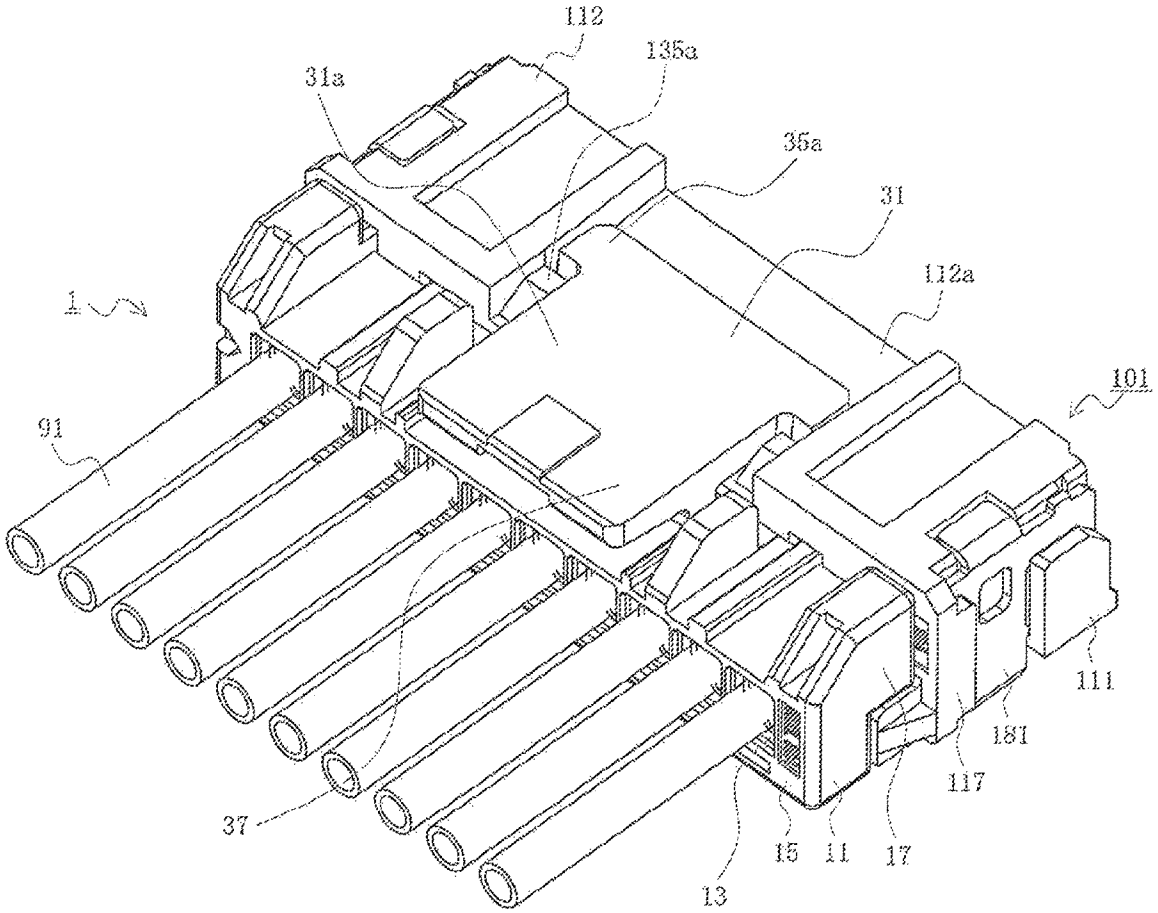
FIG. 1 is a perspective view showing a wire connector and a board connector in an embodiment of the present disclosure after they have been mated.

The following is a detailed explanation of embodiment of the present disclosure with reference to the drawings.

In the drawings, 1 is the wire connector that is the first connector in the present embodiment. This connector is connected to the end of a cable which contains a plurality of electrical wires 91. Also, 101 is the board connector that is the second connector in the present embodiment. This connector is mounted on a circuit board (not shown).

Figure 3C:
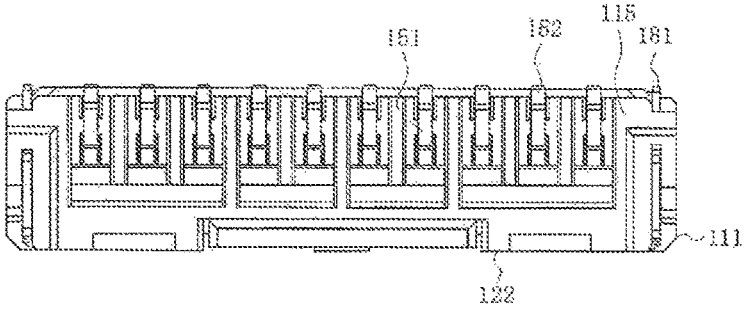
Figure 3A:
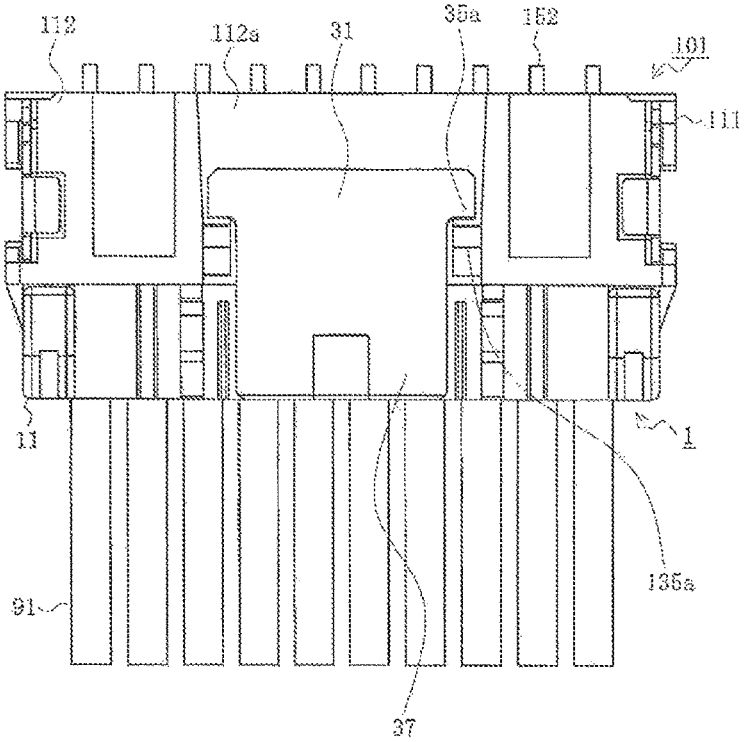
Figure 3B:
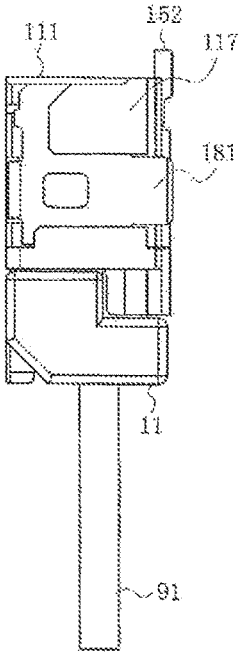

In the example shown in the drawings, the board connector 101 is a so-called right-angle connector, which is mounted sideways relative to the circuit board with the lower surface (the surface on the right in FIG. 3B and FIG. 4B) facing the surface of the circuit board. As a result, the insertion recessed portion 113 extends parallel to the circuit board. The board connector 101 is not limited to a right-angle type connector. A so-called straight type may also be used. In a straight type connector, the board connector 101 is mounted in an opening in the circuit board so as to stand upright, and the insertion recessed portion 113 extends perpendicular to the circuit board. For the sake of convenience, a right-angle type connector is used as the board connector 101 in the following explanation.

In the present embodiment, the expressions indicating direction, such as upper, lower, left, right, front and rear, which are used to explain the configuration and operation of each portion of the wire connector 1 and the board connector 101, are relative and not absolute. They depend on the orientation of the wire connector 1, the board connector 101 and their constituent components shown in the figures. When the orientation of the wire connector 1, the board connector 101, or their constituent components changes, the interpretation changes in response to the change in orientation.

The board connector 101 is integrally molded from an insulating material such as a synthetic resin, and comprises a housing 111, or second housing, mated with the wire connector 111, metal board-side terminals 151, or second terminals, mounted in the housing 111, and metal nails 181, or auxiliary fittings, for securing the housing 111 to the circuit board.

The housing 111 is a rectangular box-shaped component extending in the direction perpendicular to the mating direction with the wire connector 1 and in the direction parallel to the direction in which the board-side terminals 151 are arranged, that is, in the transverse direction of the board connector 101. The housing 111 includes a rectangular back panel portion 115, a first panel portion 112 or side panel extending from the upper edge of the back panel portion 115 in the mating direction, a second panel portion 116 or other side panel extending from the lower edge of the back panel portion 115 and extending in the mating direction, and a pair of side wall portions 117 extending from both side edges of the back panel portion 115 in the mating direction. The insertion recessed portion 113 is a box-like space opening in the forward direction whose peripheral surfaces 5 are defined by the back panel portion 115, the first panel portion 112, the second panel portion 116, and the side wall portions 117. The first panel portion 112 and the second panel portion 116 face each other, and the pair of side wall portions 117 face each other.

Each board-side terminal 151 is fitted into a through-hole formed in the back panel portion 115 and attached to the back panel portion 115. The tips of the board-side terminals 151 extend forward from the back panel portion 115, and extend into the insertion recessed portion 113 where they come into contact with the wire-side terminals, or first terminals, on the wire connector 1. The rear ends of the board-side terminals 151 are solder tail portions 152 extending to the rear from the lower edge of the back panel portion 115 where they are soldered and connected electrically to terminal-connecting pads formed on the surface of the circuit board. These terminal-connecting pads are connected electrically to conductive traces in the circuit board. In the example shown in the drawing, a total of ten board-side terminals 151 are arranged in a single row extending in the transverse direction of the board connector 101 at a pitch of 2.0 mm. However, the number, pitch, and number of rows of board-side terminals 151 are optional and can be changed if necessary.

Nails 181 are attached to both side wall portions 117. The lower ends of the nails 181 are secured by soldering to anchoring pads formed on the surface of the circuit board.

The board-side locking portions 135, or the second connector locking portions, are integrally formed in the first panel portion 112 in the transverse direction at an interval. As shown in the drawings, the board-side locking portions 135 have a shape which protrudes outward from the flat outer surface 112*a* or upper surface of the first panel portion 112. The board-side locking portions 135 include a board-side central locking portion 135*b* serving as a second central locking portion, and board-side end locking portions 135*a* serving as a pair of second end locking portions formed to the left and right of the board-side central locking portion 135*b*. The left and right board-side locking portions 135*a* are preferably separated from each other at the widest possible interval.

In the example shown in the drawings, there is a single board-side central locking portion 135*b* formed between the pair of board-side end locking portions 135*a*. However, there may be two or more board-side central locking portions 135*b*. In other words, there may be any number of board-side locking portions 135 as long as there are at least three. For the sake of convenience, there are three board-side locking portions 135 in the following explanation.

The slide fitting portion 118 used to slidingly fit into the housing 11 of the wire connector 1 is preferably formed in a position corresponding the board-side locking portion 135 in the second panel portion 116. In the example shown in the drawings, the slide fitting portion 118 includes a protruding fitting key which protrudes upwards from the inside surface of the second panel portion 116 and extends in the longitudinal direction of the board connector 101. In this case, a trench-like key groove which fits into the slide fitting portion 118 is provided on the outer surface (not shown) of the housing 11 of the wire connector 1. A recessed key groove may be formed in the slide fitting portion 118 which is recessed downward from the inside surface of the second panel portion 116 and which extends in the longitudinal direction of the board connector 101. In this case, a protruding fitting key fitting into the slide fitting portion 118 is formed on the outer surface of the second panel portion of the housing 11 of the wire connector 1.

The slide fitting portion 118 may be formed anywhere on the second panel portion 116 corresponding to a board-side locking portion 135. However, in the example shown in the drawings, it is formed in the position corresponding to the board-side central locking portion 135*b*.

A recessed portion for polarity 122 may be formed on the inner surface of the first panel portion 112 to slidably fit into a protruding portion for polarity 22 any place on the first housing 11 of the wire connector 1. In the example shown in the drawings, two right and left recessed portions or trench-like key grooves are recessed upward from the inner surface of the first panel portion 112 and extend in the longitudinal direction of the board connector 101 for a total of four recessed portions for polarity 122. However, the number and location of the recessed portions for polarity 122 can be changed.

The wire connector 1 includes a housing 11, or first housing, integrally formed from an insulating material such as a synthetic resin to be fitted into the board connector 101, and a plurality of metal wire-side terminals (not shown), or first terminals, mounted in the housing 11.

The housing 11 is a rectangular box-shaped component extending in the direction perpendicular to the mating direction with the board connector 101 and in the direction parallel to the direction in which the wires 91 are arranged, that is, in the transverse direction of the board connector 1. The housing 11 includes a rectangular back panel portion 15, a first panel portion 12 or side panel extending from the upper edge of the back panel portion 15 in the mating direction, a second panel portion (not shown) or other side panel extending from the lower edge of the back panel portion 15 in the mating direction, and a pair of side wall portions 17 extending from both side edges of the back panel portion 15 in the mating direction. The first panel portion 12 and the second panel portion face each other, and the pair of side wall portions 17 face each other.

The housing 11 also includes a plurality of terminal-accommodating recessed portions 13 opening on one end into the back panel portion 15 and extending in the longitudinal direction of the wire connector 1. The wire-side terminals (not shown) connected and secured to the front ends of the wires 91 are accommodated and held inside the terminal-accommodating recessed portions 13. Each wire 91 extends to the rear of the housing 11 from an opening in a terminal-accommodating recessed portion 13. In the example shown in the drawing, a total of ten wire-side terminals and wires 91 are arranged in a single row extending in the transverse direction of the wire connector 1 at a pitch of 2.0 mm. However, the number, pitch, and number of rows of wire-side terminals and wires 91 are optional and can be changed if necessary.

A movable arm 31 serving as a locking arm portion is integrally formed in the first panel portion 12. The movable arm 31, as shown in the drawings, includes a rectangular panel-like main body portion 31*a*, and is positioned to the outside of the substantially flat outer surface 12*a* or upper surface of the first panel portion 12 via a connecting portion 32. When the housing 11 of the wire connector 1 and the housing 111 of the board connector 101 are mated, at least a portion of the outer surface 112*a* of the first panel portion 112 of the housing 111 is covered by the movable arm 31. The connecting portion 32 is an elastically deformable member connected to the movable arm 31 between the front end and the rear end of the main body portion 31*a*. In this way, the movable arm 31 can pivot relative to the first panel portion 12 around the spot connected to the connecting portion 32.

Wire-side locking portions 35 serving as the first connector locking portions are integrally formed at intervals in the front end section of the movable arm 31 in the transverse direction of the housing 11. As described below, the wire-side locking portions 35 include a wire-side central locking portion 35*b* serving as the first central locking portion and a pair of wire-side end locking portions 35*a* serving as first end locking portions to the left and right of the wire-side central locking portion 35*b*.

The wire-side central locking portion 35*b* and the wire-side end locking portions 35*a* are the members that engage with the board-side central locking portion 135*b* and the board-side end locking portions 135*a* serving as the board-side locking portions 135. The number of wide-side locking portions corresponding to the board-side central locking portion 135*b* and the board-side end locking portions 135*a* depends on the locations of the board-side central locking portion 135*b* and the board-side end locking portions 135*a*. Here, there is a single wire-side central locking portion 35*b*, but there may be two or more wire-side central locking portions 35*b*. There may be any number of wire-side locking portions 35, such as more than three. For the sake of convenience, there are only three wire-side locking portions 35 in the present explanation.

In the example shown in the drawings, the pair of wire-side end locking portions 35*a* protrude outward in the transverse direction from the left and right ends of the movable arm 31 in the front end section of the main body portion 31*a*.

In the present embodiment, an operated portion 37 that is manually operated by the operator is provided near the rear end of the main body portion 31*a* of the movable arm 31. The locking mechanism consisting of the board-side locking portions 135 on the board connector 101 and the wire-side locking portions 35 on the wire connector 1 is a so-called positive lock. During the locking process, the board-side locking portions 135 and the wire-side locking portions 35 do not have to be operated. However, during the unlocking operation, the operator has to manually operate the operated portion 37 on the movable arm 31 to displace the wire-side locking portions 35. More specifically, when the operator pushes down the operated portion 37, the movable arm 31 pivots and the wire-side locking portions 35 formed in the front end section rise. This disengages the board-side locking portions 135 and the wire-side locking portions 35 and unlocks the connectors.

A protruding portion for polarity 22 slidingly fitted into the recessed portion for polarity 122 on the housing 111 of the board-side connector 101 is preferably formed on the outer surface 12*a* of the first panel portion 12. In the example shown in the drawings, two protruding portions for polarity 22 are formed on both the left and the right side in the longitudinal direction of the wire connector 1, for a total of four protruding portions. These are ridge-like protruding keys which project upwards from the outer surface 12*a* of the front panel portion 12. The number and location of the protruding portions for polarity 22 can be changed if desired.

The following is a detailed explanation of the configuration of the wire-side locking portions 35 and the board-side locking portions 135.

Figure 7A:
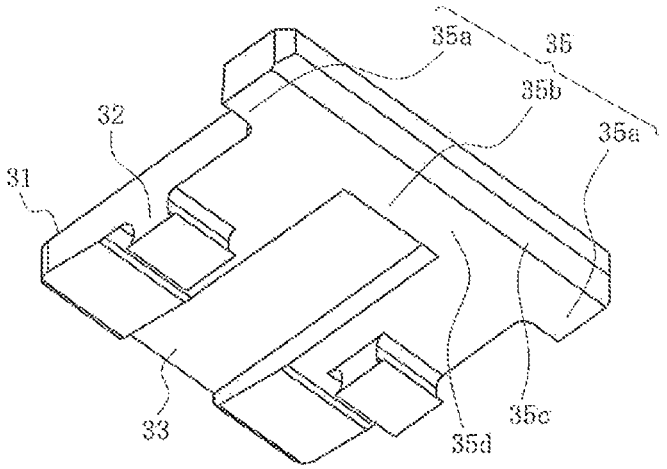
Figure 7B:
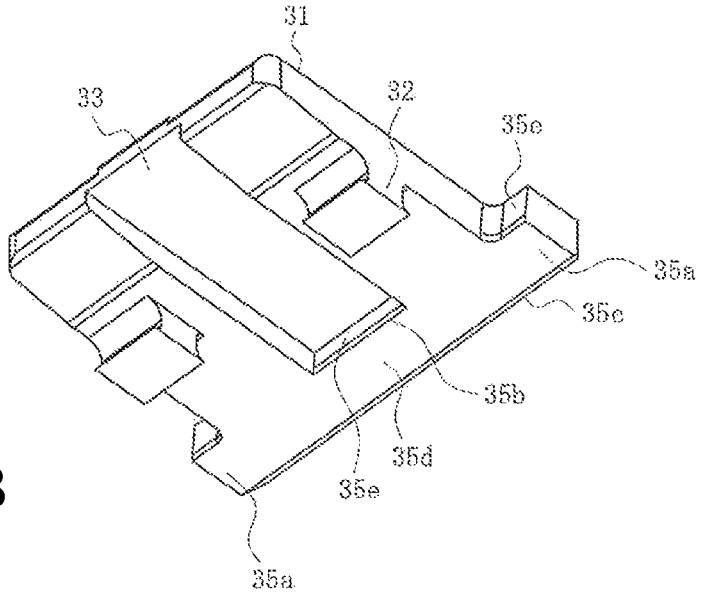

As shown in FIGS. 7A and 7B, a recessed portion 33 is formed on the inside of the main body portion 31*a* of the movable arm 31, that is, the side facing the outer surface 12*a* of the first panel portion 12. This recessed portion 33 is not formed in the front end section of the main body portion 31*a*. In this way, the wire-side central locking portion 35*b* can be formed on the inside of the front end section facing inward (downward) from the recessed portion 33, that is, somewhat towards the outer surface 12*a* of the first panel portion 12.

The depth of the recessed portion 33 should be able to accommodate the board-side central locking portion 135*b* when the wire-side central locking portion 35*b* and the board-side central locking portion 135*b* on the board connector 101 are engaged, and keep the movable arm 31 from passing through. In other words, the main body portion 31*a* of the movable arm 31 is a panel-like member in which an opening is not formed. This is much stronger than a member including an opening.

In the example shown in the drawings, the inner surfaces of the wire-side central locking portion 35*b* and the pair of wire-side end locking portions 35*a* form a flat surface 35*d* that is substantially flush. An inclined surface 35*c* connected to the front end of the flat surface 35*d* is formed in the front end of the wire-side central locking portion 35*b* and the pair of wire-side end locking portions 35*a*. A flat engaging surface 35*e* is formed on the rear ends of the wire-side central locking portion 35*b* and the pair of wire-side end locking portions 35*a*, which extends in the transverse direction and outward (upward) orthogonally with respect to the flat surface 35*d*. The inclined surfaces 35*c* and the engaging surfaces 35*e* on the wire-side central locking portion 35*b* and the pair of wire-side end locking portions 35*a* are preferably flush with each other.

Figures 6A, 6B:
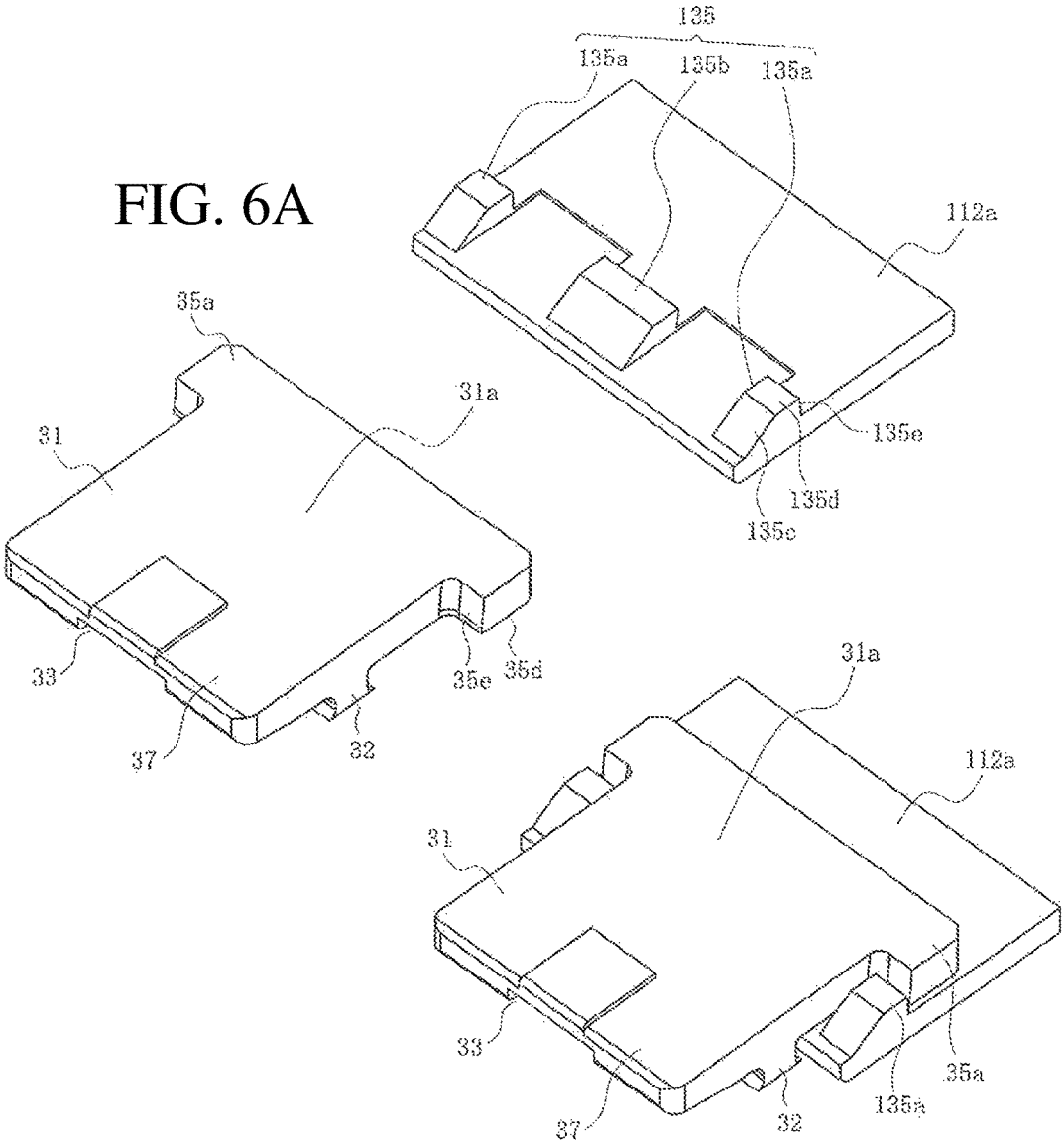

As shown in FIGS. 6A and 6B, the outer surfaces of the board-side central locking portion 135*b* and the pair of board-side end locking portions 135*a* in the board-side locking portions 135 form a flat surface 135*d* that is substantially flush. An inclined surface 135*c* connected to the front end of the flat surface 135*d* is formed in the front end of the wire-side central locking portion 135*b* and the pair of wire-side end locking portions 135*a*. Also, inclined surfaces 135*c* connected to the front ends of the flat surfaces 135*d* are formed on the front end of the board-side central locking portion 135*b* and the pair of board-side end locking portions 135*a*. In addition, a flat engaging surface 135*e* is formed on the rear ends of the board-side central locking portion 135*b* and the pair of board-side end locking portions 135*a*, which extends in the transverse direction and inward (downward) orthogonally with respect to the flat surface 135*d*. The inclined surfaces 135*c* and the engaging surfaces 135*e* on the board-side central locking portion 135*b* and the pair of board-side end locking portions 135*a* are preferably flush with each other.

Figure 5A:
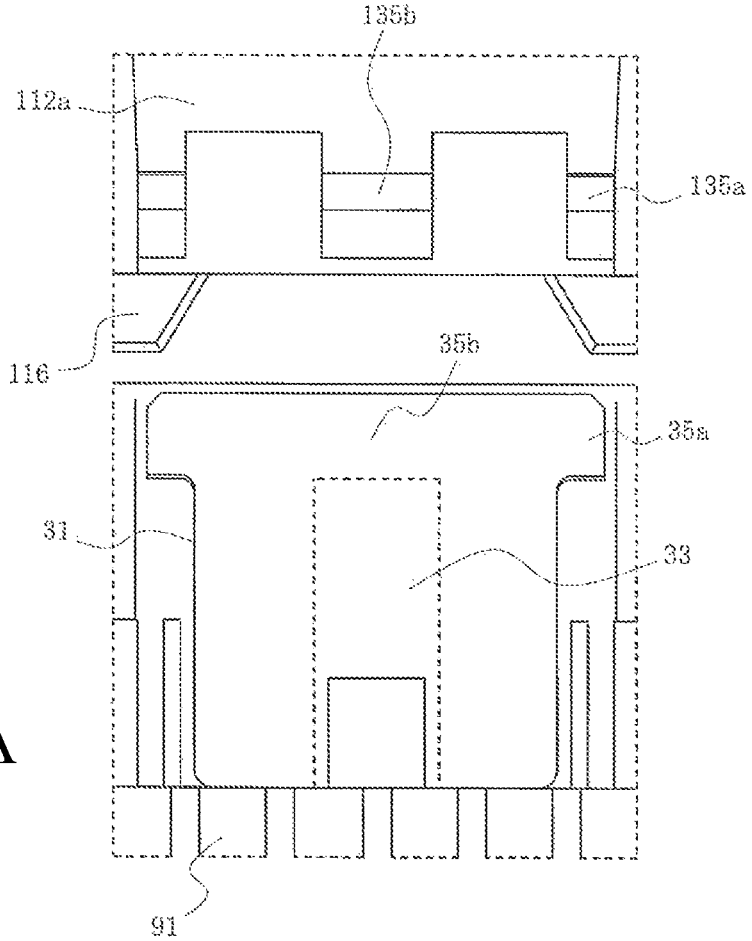
Figure 5B:
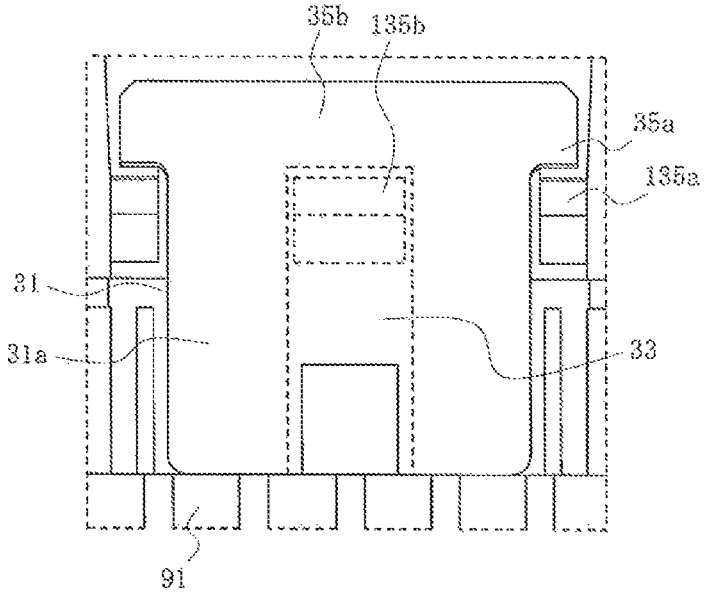

When the wire connector 1 and the board connector 101 have been mated and the wire-side locking portions 35 and the board-side locking portions 135 have been locked, the wire-side central locking portion 35*b* and the board-side central locking portion 135*b* are engaged and the left and right wire-side end locking portions 35*a* and board-side end locking portions 135*a* are engaged as shown in FIG. 5B and FIG. 6B. More specifically, the engaging surface 35*e* of the wire-side central locking portion 35*b* and the engaging surface 135*e* of the board-side central locking portion 135*b* face each other when the wire-side central locking portion 35*b* and the board-side central locking portion 135*b* engage each other. Also, the engaging surface 35*e* of the left and right wire-side end locking portions 35*a* and the engaging surface 135*e* of the left and right board-side end locking portions 135*a* face each other when the wire-side end locking portions 35*a* and the board-side end locking portions 135*a* engage each other.

The following is an explanation of the operations performed when the wire connector 1 is mated with the board connector 101.

Figure 2:
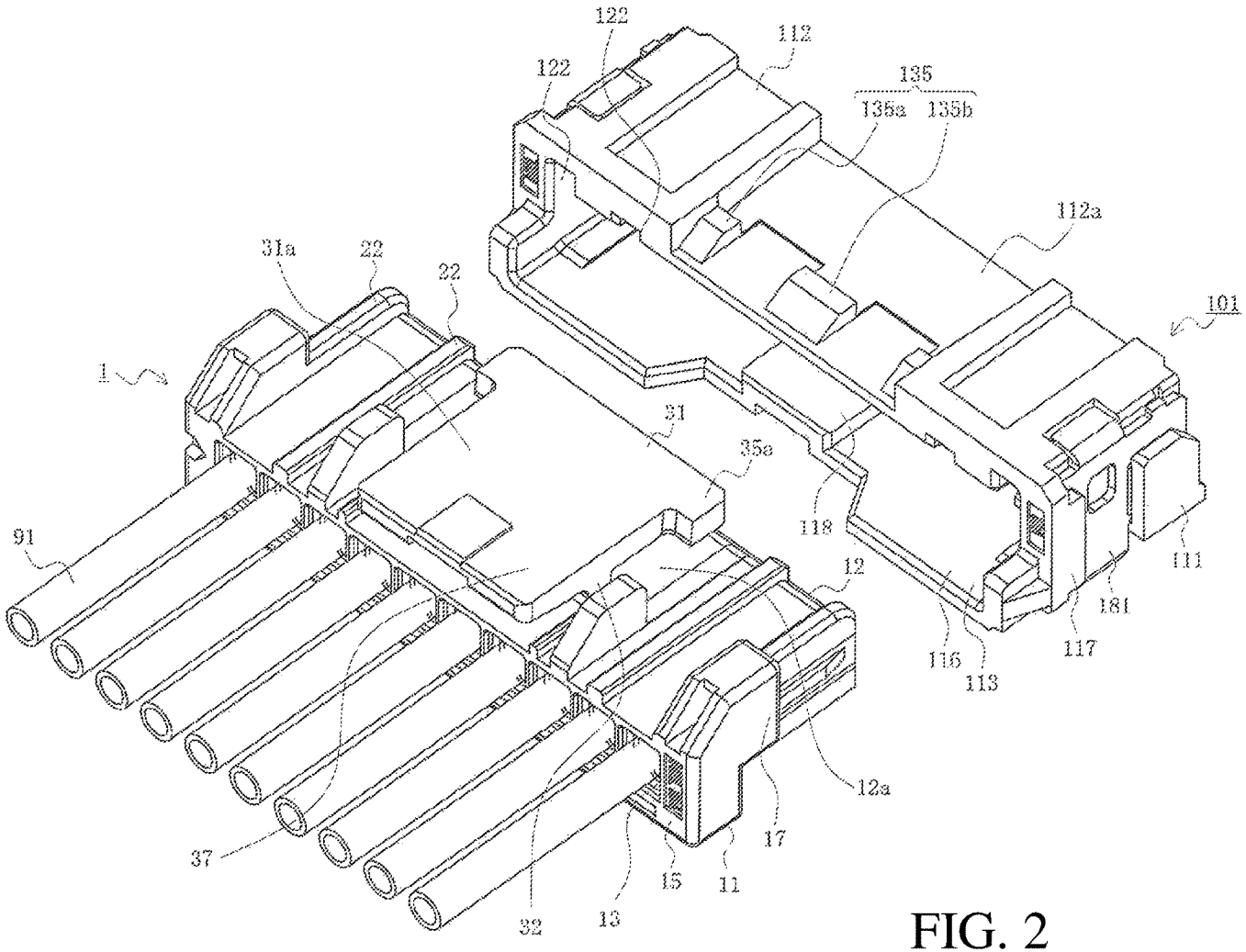
FIG. 2 is a perspective view showing a wire connector and a board connector in an embodiment of the present disclosure before they have been mated.

When a mating operation for mating a wire connector 1 with a board connector 101 mounted on a circuit board is begun, the operator manually changes the orientation of the wire connector 1 so that the front surface of the housing 11 of the wire connector 1 is facing the front surface of the housing 111 of the board connector 101 as shown in FIG. 2. The orientation of the wire connector 1 is also controlled so that the protruding portion for polarity 22 is facing the same direction as the first panel portion 112 of the board connector 101 in which the recessed portion for polarity 122 has been formed.

Figure 8A:
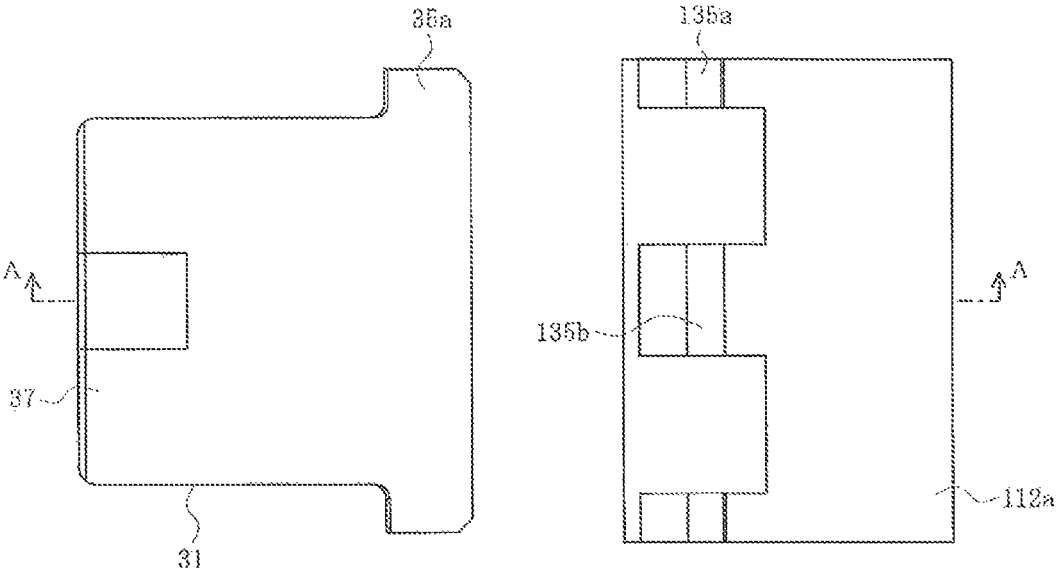
Figure 8B:
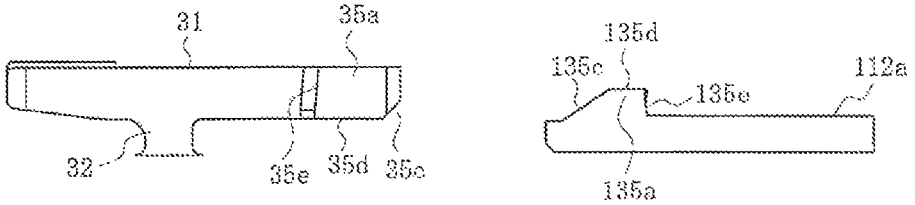
Figure 8C:
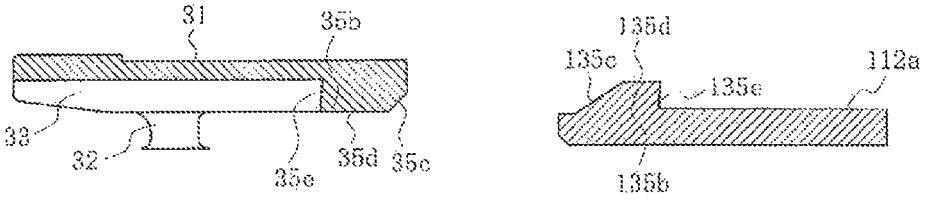

In other words, before the wire connector 1 is mated with the board connector 101, the positional relationship between the wire-side locking portions 35 and the board-side locking portions 135 is the positional relationship shown in FIGS. 8A-8C.

Figure 9A:
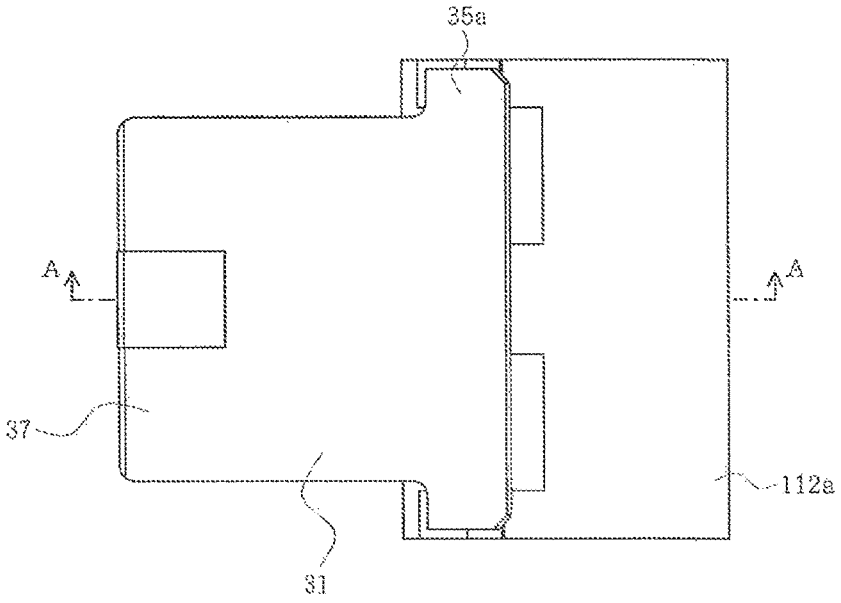
Figure 9B:
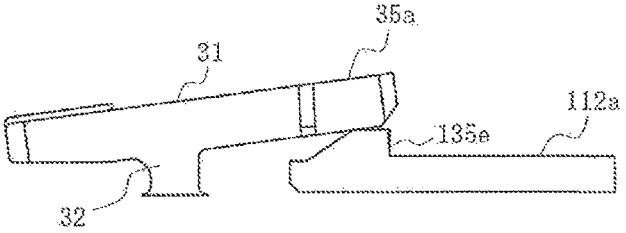
Figure 9C:
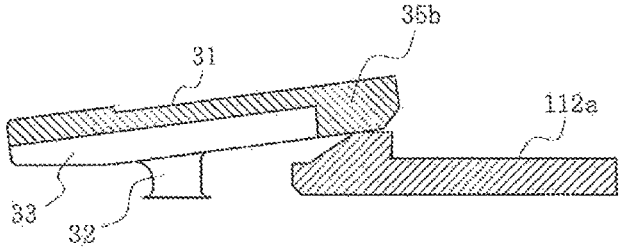

Next, the operator moves the wire connector 1 parallel to the board connector 101 and inserts the housing 11 of the wire connector 1 into the insertion recessed portion 113 in the housing 111 of the board connector 101. When the leading end of the housing 11 of the wire connector 1 has begun to enter the insertion recessed portion 113, as shown in FIGS. 9A-9C, the wire-side locking portions 35 of the wire connector 1 come into contact with the board-side locking portions 135 of the board connector 101 and ride up over the board-side locking portions 135. In this way, the front end of the movable arm 31 rises up, the connecting portion 32 becomes elastically deformed, and the movable arm 31 pivots.

Because an inclined surface 35*c* has been formed in the front end of the wire-side locking portions 35 and an inclined surface 135*c* has been formed in the front end of the board-side locking portions 135, the wire-side locking portions 35 smoothly ride up over the board-side locking portions 135 as the wire connector 1 moves forward.

Figure 10A:
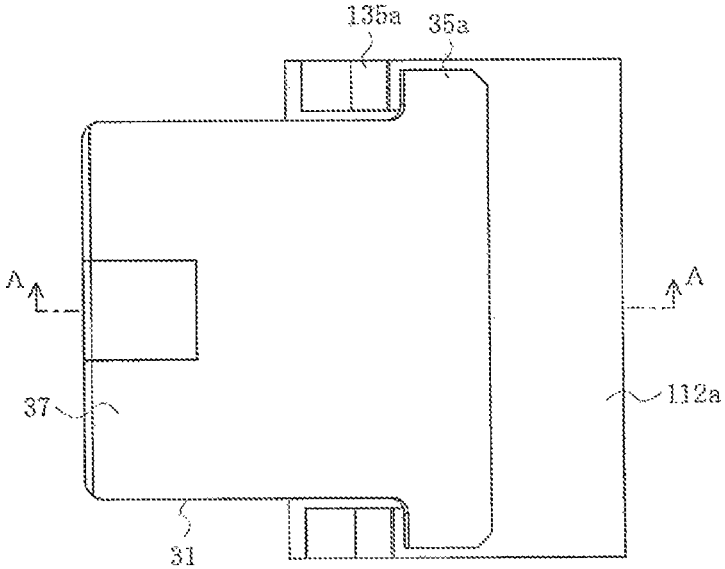
Figure 10B:
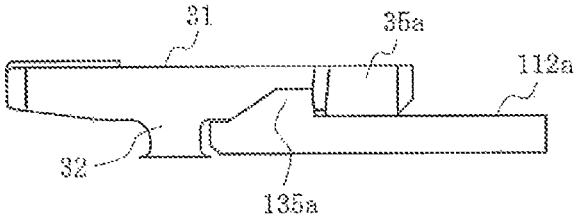
Figure 10C:
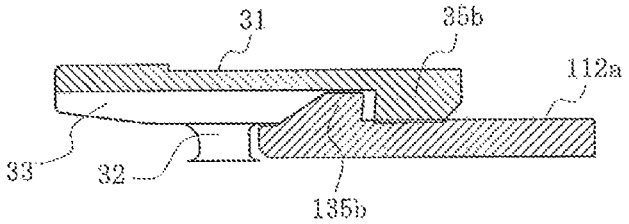

Next, when the operator advances the wire connector 1 further and the housing 101 of the wire connector 1 has been inserted into the insertion recessed portion 113, the mating of the wire connector 1 and the board connector 101 is completed, and the wire-side terminals come into contact with the corresponding board-side terminals 151 and establish an electrical connection. When the mating of the wire connector 1 and the board connector 101 has been completed, as shown in FIGS. 10A-10C, the wire-side locking portions 35 which have overcome the board-side locking portions 135 pass the board-side locking portions 135. Because the connecting portion 32 is able to rebound elastically, the front end of the movable arm 31 is lowered, and the wire-side locking portions 35 drop and engage the board-side locking portions 135.

At this time, more specifically, the wire-side central locking portion 35*b* and the board-side central locking portion 135*b* engage each other with the engaging surface 35*e* of the wire-side central locking portion 35*b* and the engaging surface 135*e* of the wire-side central locking portion 135*b* facing each other, and the left and right board-side end locking portions 35*a* and the left and right board-side end locking portions 135*a* engage each other with the engaging surfaces 35*e* of the left and right wire-side central locking portions 35*a* and the engaging surface 135*e* of the left and right board-side end locking portions 135*a* facing each other. In this way, the wire-side locking portions 35 and the board-side locking portions 135 are reliably locked, and the wire connector 1 and the board connector 101 do not become inadvertently disengaged from each other.

When the mated wire connector 1 and board connector 101 have to be disengaged from each other, the operator manually presses down on the operated portion 37, the movable arm 31 pivots, and the wire-side locking portions 35 formed in the front end rise. When the board-side locking portions 135 and the wire-side locking portions 35 have been disengaged and unlocked in this way, the operator can move the wire connector 1 in the direction opposite the mating direction, and the wire connector 1 can be removed from the board connector 101.

However, during the mating operation performed to mate the wire connector 1 with the board connector 101, the housing 11 of the wire connector 1 may be inserted into the insertion recessed portion 113 of the housing 111 of the board connector 101 while skewed in the transverse direction.

Figure 11A:
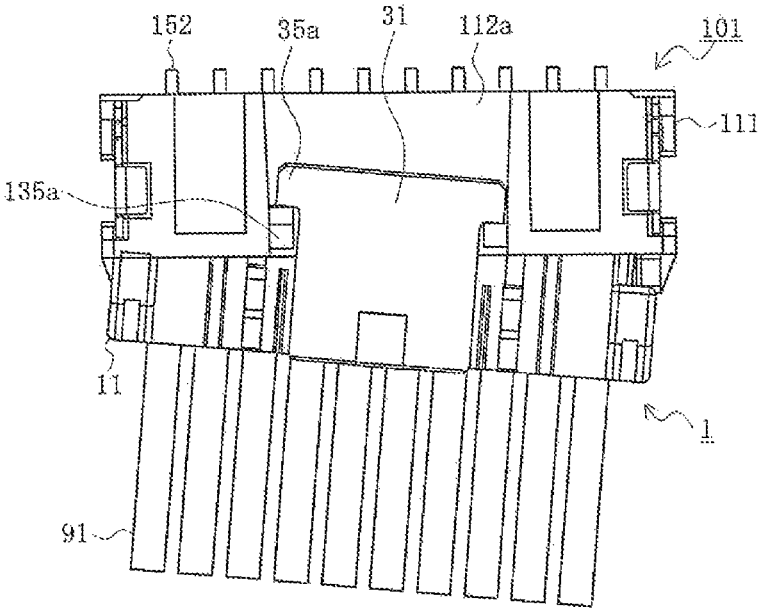
Figure 11B:
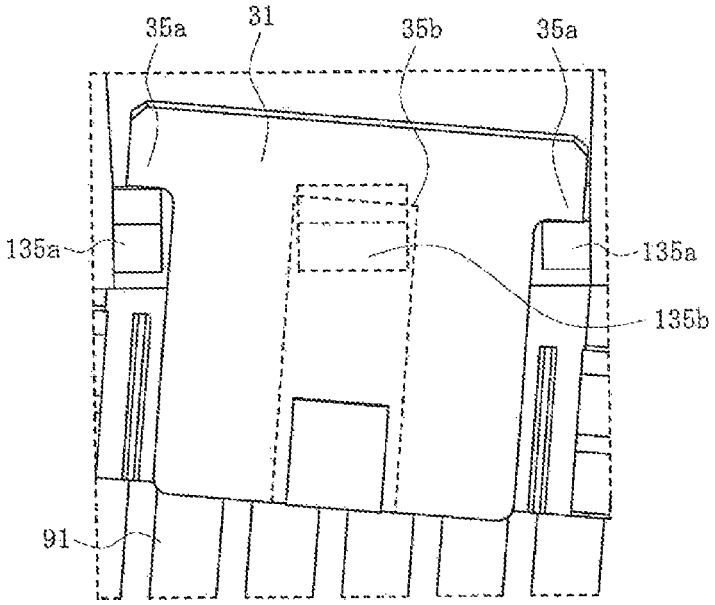
Figure 12:
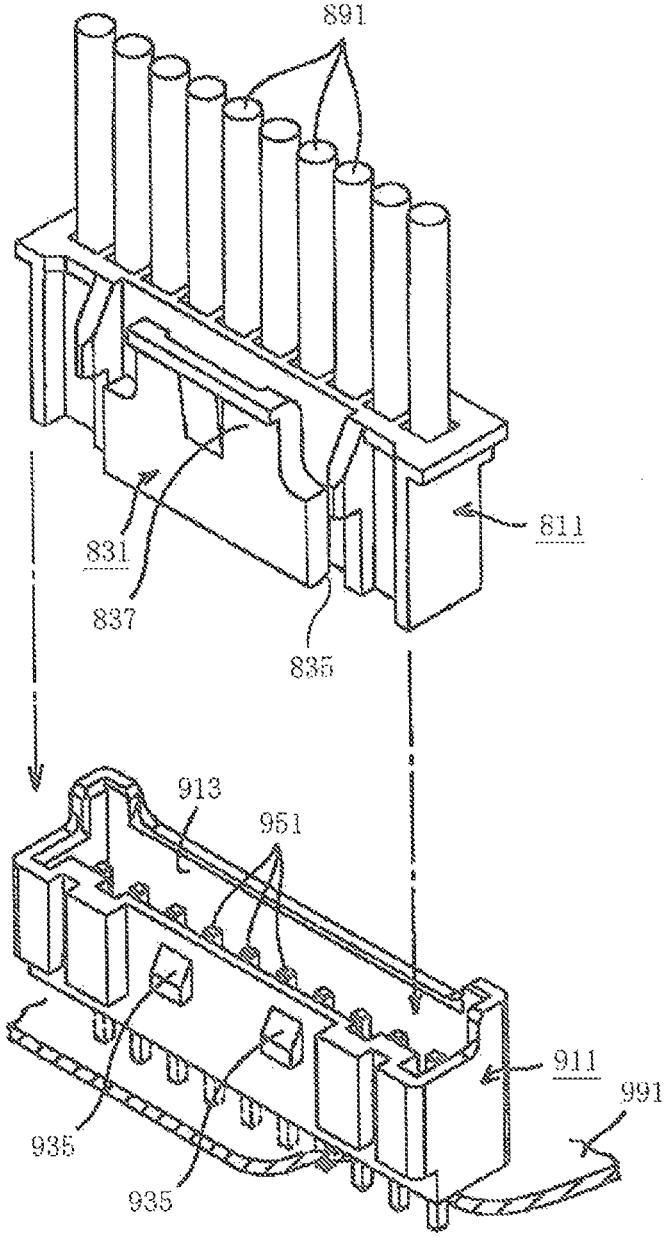
FIG. 12 PRIOR ART
FIG. 12 is a perspective view showing the situation before a connector of the prior art is mated.

In the example shown in FIGS. 11A and 11B, the housing 11 of the wire connector 1 is inserted into the insertion recessed portion 113 of the housing 111 while skewed relative to the centerline in the transverse direction of the housing 111 of the board connector 101. In the present example, the left side of the housing 11 of the wire connector 1 is inserted deeply into the insertion recessed portion 113 and the right side of the housing 11 of the wire connector 1 is inserted shallowly into the insertion recessed portion 113. As a result, the wire-side terminals near the right end of the housing 11 may not come into contact with the corresponding board-side terminals 151 even if the wire-side terminals near the left end of the housing 11 come into contact with the corresponding board-side terminals 151.

Here, as is clearly shown in FIG. 11B, the wire-side end locking portion 35*a* on the left end passes over the corresponding board-side end locking portion 135*a*, while the wire-side central locking portion 35*b* and the wire-side end locking portion 35*a* on the right side are positioned above the corresponding board-side central locking portion 135*b* and board-side end locking portion 135*a*. As a result, the front end of the movable arm 31 does not drop, and the wire-side central locking portion 35*b* and the wire-side end locking portion 35*a* on the right side do not engage the corresponding board-side central locking portion 135*b* and board-side end locking portion 135*a*. As a result, the operator does not hear or feel a click generated by the wire-side locking portions 35 engaging the board-side locking portions 135.

Therefore, as shown in FIGS. 11A and 11B, when the housing 11 of the wire connector 1 is inserted into the insertion recessed portion 113 of the housing 111 of the board connector 101 while skewed in the transverse direction, the operator does not mistakenly conclude that the locking operation has been completed. Because the wire-side end locking portion 35*a* on the right side passing over the corresponding board-side end locking portion 135*a* can be visually confirmed, the operator can visually confirm that the locking operation has not been completed.

If, in the example shown in FIGS. 11A and 11B, the wire-side central locking portion 35*b* and the board-side central portion 135*b* are not present, the wire-side end locking portion 35*a* on the left side passes over the corresponding board-side end locking portion 135*a* even when the wire-side end locking portion 35*a* on the right side is positioned above the corresponding board-side end locking portion 135*a*. Therefore, the movable arm 31 becomes twisted, only the left front end drops, and only the wire-side end locking portion 35*a* on the left side engages the corresponding board-side end locking portion 135*a*.

However, in the present disclosure, a wire-side central locking portion 35*b* is present in the center in the transverse direction of the movable arm 31, and a board-side central locking portion 135*b* is present in the middle of the housing 111 of the board connector 101 in the transverse direction of the first panel portion 112. As a result, the central portion of the movable arm 31 in the transverse direction is supported from below by the board-side central locking portion 135*b*. Therefore, even when the wire-side end locking portion 35*a* on the left side passes over the corresponding board-side end locking portion 135*a*, the movable arm 31 does not twist and the front left end does not drop alone. Consequently, a situation is prevented in which only the wire-side end locking portion 35*a* on the left side engages the corresponding board-side end locking portion 135*a*.

In the present embodiment, the connector comprises a wire connector having a housing 11 and wire-side terminals (not shown) mounted in the housing 11, and a board connector 101 having a housing 111 fitted into the housing 11 of the wire connector 1 and board-side terminals 151 mounted in the housing 111 and making contact with the wire-side terminals. As shown in FIG. 1 through FIG. 4C, the housing 111 in the board connector 101 includes a first panel portion 112 extending in the mating direction, and at least three board-side locking portions 135 protruding from the outer surface 112*a* of the first panel portion 112, the board-side locking portions 135 being arranged at intervals in the transverse direction of the housing 111. Also, the housing 11 of the wire connector 1 includes a first panel portion 12 extending in the mating direction, a movable arm 31 formed in the first panel portion 12, the movable arm 31 at least partially covering the outer surface 112*a* of the first panel portion 112 of the housing 111 when the housing 11 of the wire connector 1 is mated with the housing 111 of the board connector 101, and at least three wire-side locking portions 35 formed in the movable arm 31 at intervals in the transverse direction of the housing 11, the three or more wire-side locking portions 35 engaging the board-side locking portions 135 when the housing 11 of the wire connector 1 is mated with the housing 111 of the board connector 101.

In this way, as shown in FIGS. 11A and 11B, when the housing 11 of the wire connector 1 is skewed in the transverse direction relative to the housing 111 of the board connector 101, none of the wire-side locking portions 35 engage their corresponding board-side locking portion 135, and the wire-side locking portions 35 and board-side locking portions 135 do not become locked. As a result, the operator does not mistakenly believe that the connectors have been locked.

Also, because at least three wire-side locking portions 35 formed at intervals in the transverse direction of the housing 11 engage at least three board-side locking portions 135 formed at intervals in the transverse direction of the housing 111, when the housing 11 of the wire connector 1 and the housing 111 of the board connector 101 are properly mated and become locked as shown in FIG. 1, FIGS. 3A-3C, and FIGS. 5A and 5B, the wire-side locking portions 35 and board-side locking portions 135 do not become disengaged when external force is applied in the disengaging direction of the housing 11 of the wire connector 1 and the housing 111 of the board connector 101, even when the external force is applied obliquely to the housing 11 of the wire connector 1 relative to the housing 111 of the board connector 101 in the transverse direction. Therefore, the housing 11 of the wire connector 1 and the housing 111 of the board connector 101 do not become disengaged and the wire connector 1 does not become detached from the board connector 101.

As shown in FIG. 6A through FIG. 8C, the board-side locking portions 135 each have a flat surface 135*d*, an inclined surface 135*c* connected to the front end of the flat surface 135*d*, and an engaging surface 135*e* connected to the rear end of the flat surface 135*d*. They have a similar side profile and are formed in the same position relative to the mating direction. The wire-side locking portions 35 each have a flat surface 35*d*, an inclined surface 35*c* connected to the front end of the flat surface 35*d*, and an engaging surface 35*e* connected to the rear end of the flat surface 35*d*. They have a similar side profile and are formed in the same position relative to the mating direction.

Therefore, when the housing 11 of the wire connector 1 is moved in the mating direction relative to the housing 111 of the board connector 101, the wire-side locking portions 35 are not subjected to strong resistance from the board-side locking portions 135, and all of the wire-side locking portions 35 and board-side locking portions 135 engage each other smoothly. Also, the wire-side locking portions 35 and board-side locking portions 135 do not disengage from each other even when external force is applied in the disengaging direction of the housing 11 of the wire connector 1 and the housing 111 of the board connector 101. Therefore, the housing 11 of the wire connector 1 and the housing 111 of the board connector 101 do not become disengaged, and the wire connector 1 does not become detached from the board connector 101.

Also, as shown in FIG. 1 through FIG. 8C, the board-side locking portions 135 include at least one board-side central locking portion 135*b* and a pair of board-side end locking portions 135*a* formed on both ends, and the wire-side locking portion 35 includes at least one wire-side central locking portion 35*b* and a pair of wire-side end locking portions 35*a* formed on both ends.

Therefore, because the interval between the board-side end locking portions 135*a* and the interval between wire-side end locking portions 35*a* formed on both ends are wide, when the housing 11 of the wire connector 1 and the housing 111 of the board connector 101 are properly mated and become locked, the wire-side end locking portions 35*a* and board-side end locking portions 135*a* do not become disengaged when external force is applied in the disengaging direction of the housing 11 of the wire connector 1 and the housing 111 of the board connector 101, even when the external force is applied obliquely to the housing 11 of the wire connector 1 relative to the housing 111 of the board connector 101 in the transverse direction. Therefore, the housing 11 of the wire connector 1 and the housing 111 of the board connector 101 do not become disengaged and the wire connector 1 does not become detached from the board connector 101.

Also, as shown in FIGS. 7A and 7B, the movable arm 31 includes a panel-like main body portion 31*a* without an opening, the wire-side end locking portions 35*a* protrude from the left and right ends near the front end of the main body portion 31*a*, and the wire-side central locking portion 35*b* is formed on the inside surface of the main body portion 31*a*, that is, a surface opposing at least some of the outer surface of the first panel portion 112 of the housing 111 when the housing 11 of the wire connector 1 is mated with the outer surface 112*a* of the first panel portion 112 of the housing 111.

Because the main body portion 31*a* is a panel-like member without an opening, the strong movable arm 31 is not easily deformed. Therefore, when the movable arm 31 becomes twisted, neither the left nor the right wire-side end locking portion 35*a* near the front end of the main body portion 31*a* drops and engages the board-side end locking portion 135*a* alone. Also, the wire-side locking portions 35 and board-side locking portions 135 do not become disengaged even when the housing 11 of the wire connector 1 and the housing 111 in the board connector 101 are subjected to external force in the disengaging direction. Therefore, the housing 11 of the wire connector 1 and the housing 111 of the board connector 101 do not become disengaged and the wire connector 1 does not become detached from the board connector 101.

Also, as shown in FIG. 1 and FIGS. 4A-4C, when the housing 11 of the wire connector 1 and the housing 111 of the board connector 101 are mated, the wire-side end locking portions 35*a* and the board-side end locking portions 135*a* are engaged visibly from beyond the movable arm 31, and the wire-side central locking portion 35*b* and the board-side central locking portion 135*b* are not engaged visibly from beyond the movable arm 31.

Because the wire-side end locking portions 35*a* and board-side end locking portions 135*a* are visibly engaged from beyond the movable arm 31, the operator can visibly confirm whether or not the locking operation has been completed. As a result, the operator does not mistakenly conclude that the locking operation has been completed.

The housing 111 of the board connector 101 also includes a second panel portion 116 opposing the first panel portion 112, and a slide fitting portion 118 formed on the second panel portion 116 in a position corresponding to the board-side locking portions 135, the slide fitting portion 118 being a ridge-like fitting key or a trench-like key groove. The housing 11 of the wire connector 1 also includes a ridge-like fitting key or a trench-like key groove that is mated with the slide fitting portion 118.

When the housing 11 of the wire connector 1 is mated with the housing 111 of the board connector 101, the housing 11 of the wire connector 1 is effectively kept from becoming skewed relative to the housing 111 of the board connector 101 in the transverse direction.

In the disclosure of the present specification, characteristics related to specific preferred embodiments were described. A person of ordinary skill in the art could naturally devise other embodiments, modifications, and variations with reference to the disclosure of the present specification without departing from the spirit and scope of the appended claims.

The present disclosure can be applied to connectors.

The invention claimed is:

1. A connector assembly comprising:

a first connector including a first housing and first terminals, the first terminals being embedded in the first housing; and a second connector including a second housing and second terminals, the second terminals being embedded in the second housing, the second terminals contacting the first terminals, the second housing having a second side panel extending in a mating direction and at least three second connector lock portions protruding from an outer surface of the second side panel, the second connector lock portions each being arranged in a transverse direction of the second housing and separated by an interval, and the first housing including a first side panel extending in the mating direction, a locking arm portion formed in the first side panel and covering at least a portion of the outer surface of the second side panel of the second housing when the first housing and the second housing are mated, and at least three first connector locking portions each formed in the locking arm portion in the transverse direction of the first housing and separated by an interval, and each engaging a second connector lock portion when the first housing and the second housing are mated.

2. The connector assembly according to claim 1, wherein the second connector lock portions have similar side profiles and are formed in the same position relative to the mating direction, and the first connector locking portions have similar side profiles and are formed in the same position relative to the mating direction.

3. The connector assembly according to claim 1, wherein each second connector lock portion has at least one second central lock portion and a pair of second end lock portions on both ends, and each first connector locking portion has at least one first central locking portion and a pair of first end locking portions on both ends.

4. The connector assembly according to claim 3, wherein the locking arm portion includes a main body portion having no opening, a first end locking portion protruding from both left and right ends of a front end section of the main body portion, and the first central locking portion is an inner surface of the main body portion opposing at least some of the outer surface of the second side panel of the second housing when the first housing and the second housing are mated.

5. The connector assembly according to claim 4, wherein the first end locking portion and the second end lock portion engage each other visibly from outside of the locking arm portion, and the first central locking portion and the second central lock portion engage each other non-visible from outside of the locking arm portion when the first housing and the second housing are mated.

6. The connector assembly according to claim 1, wherein the second housing includes another side panel facing the second side panel, and a slide fitting portion formed at a position corresponding to the second connector lock portion in the other side panel, the slide fitting portion being a ridge-like protruding key or trench-like key groove, and the first housing includes a trench-like key groove or ridge-like protruding key fitting into the slide fitting portion.

7. The connector assembly according to claim 1, wherein the first connector is a wire connector connecting the first terminals to electrical wires, and the second connector is a board connector connecting the second terminals to a board.

* * * * *